United States Patent [19]

Zaitsu

[11] Patent Number: 4,892,311

[45] Date of Patent: Jan. 9, 1990

[54] GAME PLAYING MACHINE EQUIPPED WITH A VIBRATING FEEDER

[75] Inventor: Kouji Zaitsu, Yokohama, Japan

[73] Assignee: Bonanza Enterprises, Ltd., Yokohama, Japan

[21] Appl. No.: 240,722

[22] Filed: Sep. 6, 1988

[30] Foreign Application Priority Data

Dec. 18, 1987 [JP] Japan ..... 62-192332[U]
Apr. 29, 1988 [JP] Japan ..... 63-58104[U]

[51] Int. Cl.[4] ..... A63F 9/04
[52] U.S. Cl. ..... 273/145 D; 273/145 R
[58] Field of Search ..... 273/145 R, 145 A, 145 B, 273/145 C, 145 CA, 145 D, 145 E; 198/373, 609

[56] References Cited

U.S. PATENT DOCUMENTS 2,302,333 11/1942 Linke ..... 273/145 CA
2,378,722 6/1945 Nicholas ..... 273/145 R
2,693,962 11/1954 Stevens ..... 273/145 D

*Primary Examiner*—Anton O. Oechsle
*Attorney, Agent, or Firm*—Cushman, Darby & Cushman

[57] ABSTRACT

A vibrating feeder type die machine having a die retrieving feeder of a generally rectangular shape and a spot counting feeder of an elongated channel. Both feeders are integrally connected so that the die may roll down from the die retrieving feeder to the spot counting channel. The vibration of the spot counting channel will cause the die to move forward to the spot counting position in the channel. After the number of spots on a selected side of the die is counted automatically, the die is pushed up to the dice retrieving feeder plane. The die machine may be equipped with die rolling means, which can be controlled by a player.

6 Claims, 17 Drawing Sheets

GAME PLAYING MACHINE EQUIPPED WITH A VIBRATING FEEDER

BACKGROUND OF THE INVENTION

1. Field of the Invention

The present invention relates to a game playing machine equipped with a vibrating feeder, and particularly a dice playing machine in which at least one die is thrown, and the result of the game depends on the number of spots on its selected side.

2. Description of the Prior Art

When playing dice, one or two dice are thrown on a table, sometimes after putting the dice in a dice cup and shaking the dice cup, and then a decision as to who wins or loses the game is made on the basis of the number of spots from 1 to 6 on a selected side of the die. These acts are usually performed by a person, and therefore the game cannot be conducted quickly. In an attempt to increase the speed of the game, and accordingly the excitement in the game. a variety of dice playing machines have been proposed and actually used.

One of these machines is an electronic game playing apparatus using a cathode ray tube and a computer program. In operation, a die appears on the screen, and the die is rolled by depressing selected buttons. The game is quick, but the player cannot have an actual feeling of the die; no actual die is used, and the game is played on the flat space. No excitement can be caused by the image of die appearing on the flat screen.

Another conventional die machine uses a vibrating feeder. In this machine an actual die is thrown on the vibrating feeder, and then the die is rolled about in all directions. The vibrating feeder has a flat space large enough to permit a die to fall on the flat surface without turning aside therefrom, no matter which directions the die may be thrown, thus not requiring the player's careful control in throwing the die. The rolling of the die on the table in all directions increases excitement in the game. After the die rolls about on the vibrating table, it is brought to a given place where the player counts the number of spots on a selected side of the die to make a decision on the game.

This die machine, however, is not very quick. In the hope of providing a quicker game it has been proposed that a vibrating feeder type die machine be equipped with an automatic die spot counting device using for instance, photosensors for counting the number of spots on a selected side of the die. In order to assure accuracy in counting of the number of spots, however, it is necessary to bring the die to a relatively small place, and put the die in a position appropriate for automatic spot-counting. It is, however, difficult to put the die into the desired counting position after rolling and falling out of the relatively large space on which the die rolls about in all directions. Thus, there is the fear of miscounting the spots of the die.

SUMMARY OF THE INVENTION

One object of the present invention is to provide a vibrating feeder type die machine equipped with an automatic spot counter, permitting the die to be guided to the counting position from the extensive place on which the die is to be rolled. The vibrating table can be large enough to permit the die to fall on the vibrating area without turning aside therefrom, not requiring the player's careful control, and accordingly increasing amusement, still assuring that the die can be guided to a relatively small counting area after leaving the relatively large vibrating area.

Another object of the present invention is to provide a vibrating feeder type die machine which permits a player to control the vibrating mode of the vibrating feeder, trying to cause the appearance of a selected number of spots which he desires. The die can be rolled or raised and lowered after falling on the vibrating feeder, and this increases amusement and excitement because of the thrill of anticipation for desired result.

Still another object of the present invention is to provide a vibrating feeder type die machine equipped with an automatic spot counter which is less expensive, still assuring the exact counting of die spots. The die machine can provide the thrill and speed people are seeking in these modern times.

To attain these objects a die machine according to the present invention is equipped with a vibrating feeder which is composed of two divisional sections integrally connected with each other, one divisional section being allotted to receiving a die when thrown, and having a transporting surface large enough to receive the die and allow it to roll about in all directions, and the other divisional section being allotted to counting the number of spots of a selected side of the die, and having spot counting means and a transporting channel to permit the linear transportation of the die to a counting place where the spot counting means reads and counts the number of spots of a selected side of the die. Also, one divisional section has means to permit the exterior control of rolling of the die on the transporting surface. Thus, a player can roll the die in the hope of causing the appearance of the desired number of spots. This increases the thrill of anticipation, and hence excitation and amusement.

In operation, no matter which direction a die may be thrown, the die falls on the die retrieving feeder plane without turning aside therefrom because the die retrieving feeder plane is large enough. The vibration of the die retrieving feeder causes the die to move to the spot counting feeder channel, which is contiguous to the die retrieving feeder plane. When the die is shifted to the spot counting channel, it is brought to the spot counting position because the channel vibrates to cause the die to advance along the straight channel to the spot counting position without allowing the die to turn aside from the course.

After bringing the die from the die retrieving feeder plane to the spot counting position, the number of a selected side of the die is counted by an automatic spot counting device. Thanks to a unique arrangement of photodetectors according to the present invention, an automatic spot counting device which is less expensive than the one used in a conventional die machine is provided.

The die rolls about on the die retrieving plane quickly, and it is brought to the counting position in the spot counting feeder channel smoothly. This quick move increases excitement.

In case of providing the die machine with a die rolling means, a single or plurality of die which may be thrown one after another or simultaneously, will be subjected to, push-and-roll which rolling about on the retrieving feeder plane. A player can control the die rolling means in the hope of causing the desired number of spots to appear. This will increase the thrill of anticipation, and hence the excitement will be increased even more.

Other objects and advantages of the present invention will be understood from the following description of the die machine according to preferred embodiments of the present invention, which die machines are shown in the accompanying drawings:

FIG. 1 is a perspective view of an integration of a die retrieving feeder and a spot number counting feeder;

FIG. 2 is a side view of the integration of the die retrieving and spot number counting feeders;

FIG. 3 is a perspective view of the whole die machine;

FIG. 4 is a perspective view of the structure of the die machine, showing a bucket and associated mechanism;

FIG. 5 is a plane view of the spot number counting feeder with a plurality of dice arranged at one end of the feeder;

FIG. 6 is a plane view of the spot number counting feeder with some dice fallen in the bucket when the game starts;

FIG. 7 shows how a die is thrown;

FIG. 8 is a plane view of the spot number counting feeder, showing how the die can be put in the spot counting position;

FIG. 9 is a perspective view of the spot counting place;

FIG. 10 shows the relation between the spot counting sensor and a die;

FIG. 11 is shows the sides of the die;

FIG. 12 show the relationship between the spot numbers of opposite sides of the dice, and the spot numbers appearing in upper and lower detecting zones;

FIG. 13 is a perspective view of a bucket lift;

FIG. 14 is a perspective view of one side wall of the bucket and an associated post attached to the endless belt; and FIG. 15 is a perspective view of a die stopper mechanism.

FIG. 16 is a perspective view of a die retrieving feeder and a spot number counting feeder;

FIG. 17 is a similar view, but showing an electromagnetic vibrating means;

FIG. 18 is a perspective view of square arrangement of vertically movable pins and a rotatable arm;

FIG. 19 is a perspective view of pin and drivers;

FIG. 20 is a perspective view of pin and arm drivers as seen from underside, showing eccentric cams in detail;

FIG. 21 is a perspective view of a pin matrix;

FIG. 22 is a sectional view, showing how the eccentric cam works;

FIG. 23 is a sectional view, showing the pin and arm driving mechanisms; and FIG. 24 shows how the die is transported in the die retrieving and spot counting feeders.

Referring to FIGS. 1 to 15, there is shown a die machine according to the first embodiment of the present invention.

A die machine having a single vibrating feeder, is well known. In use a die is thrown on the vibrating feeder, and then the die while being subjected to vibration, is transported in a predetermined direction. Finally, the die stops, and then the number of spots on a selected side of the die is counted to decide who wins or loses in the game. Magnetic means and spring means are used to subject the die to vibration of a fixed amplitude and frequency.

Figure 1:
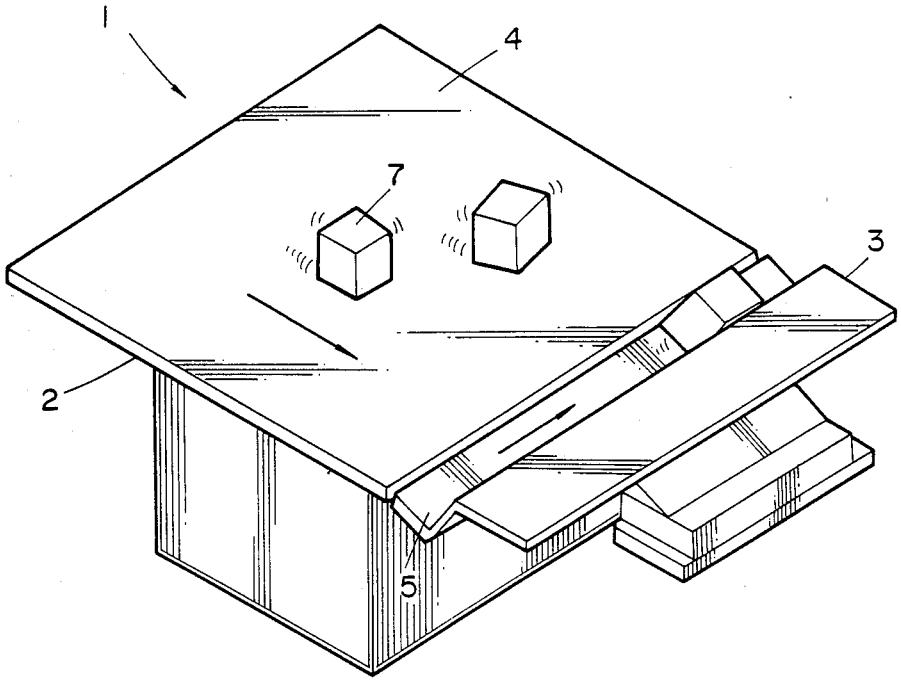
FIGS. 1 to 15 show a die machine according to a first embodiment of the present invention.
Figure 2:
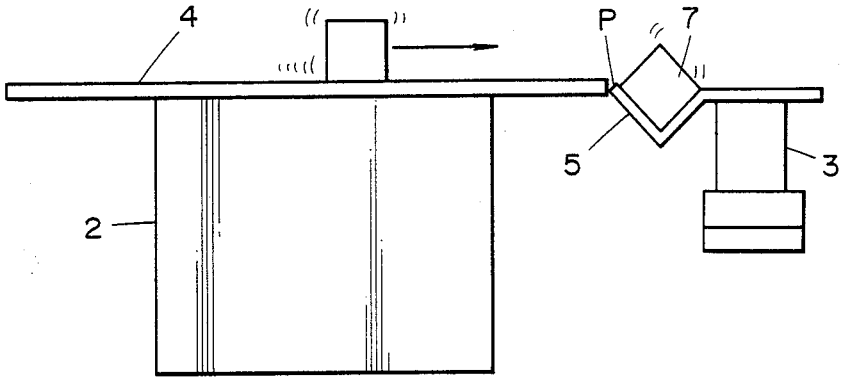

Such a vibrating type die machine is improved according to the present invention in that the vibrating feeder is composed of two divisional sections integrally connected with each other. As shown in FIGS. 1 and 2, the vibrating feeder has a die retrieving feeder 2 and a spot counting feeder 3. The die retrieving feeder 2 has a transporting surface 4, and the spot counting feeder 3 has a transporting channel 5. The transporting surface 4 is contiguous with the transporting channel 5 along the boundary P therebetween. The transporting surface 4 and channel 5 have different vibrations.

The transporting surface 4 functions to receive a die 7 when thrown and transport the die to the transporting channel 5. The transporting surface 4 is large enough to allow a die to fall and roll about on the transporting surface without turning aside therefrom no matter in which directions the die may be thrown. The transporting channel 5 functions to guide the die straight to the spot counting position 6A, which is later described in detail. As seen from FIG. 2, the linear transporting channel 5 has a "V"-shaped cross section. Specifically, it has an equilateral right-angled triangle space, which is large enough to snugly accept the die. It is fixed to the transporting surface 4 with its one side slant to the flat plane. With this arrangement the die will be caused to advance and drop from the die retrieving feeder 4 to the channel space 5. Then, it will be transported direct to the spot counting position 6A.

Figure 9:
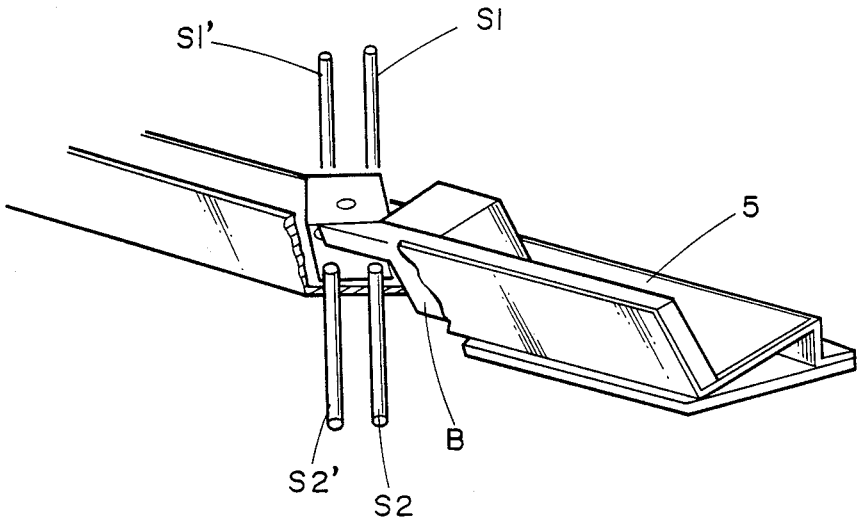

As is best shown in FIG. 9, the transporting channel 5 has a guide block B having a slant extension. Specifically, the guide block B is put downstream of a place on which the die drops from the transporting plane 4. The spot counting position 6A is at the slant extension of the guide block B. Thus, a die whose spots are to be counted at the spot counting position 6A, claims the slant extension of the guide block B, thereby putting it in a different position other than subsequent dice in the linear channel 5 to prevent a spot counting sensor TS from miscounting.

Figure 10:
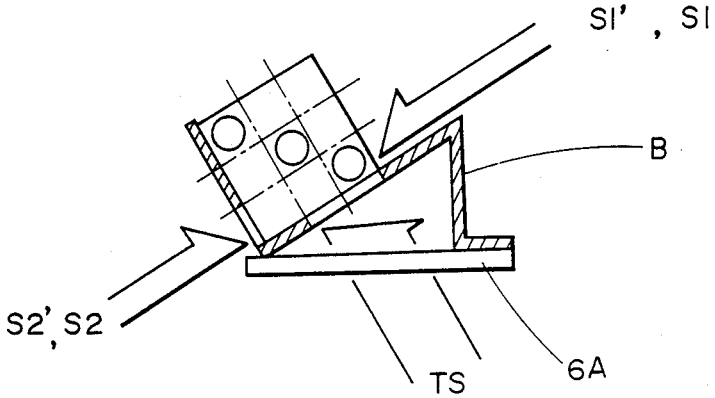
Figure 11:
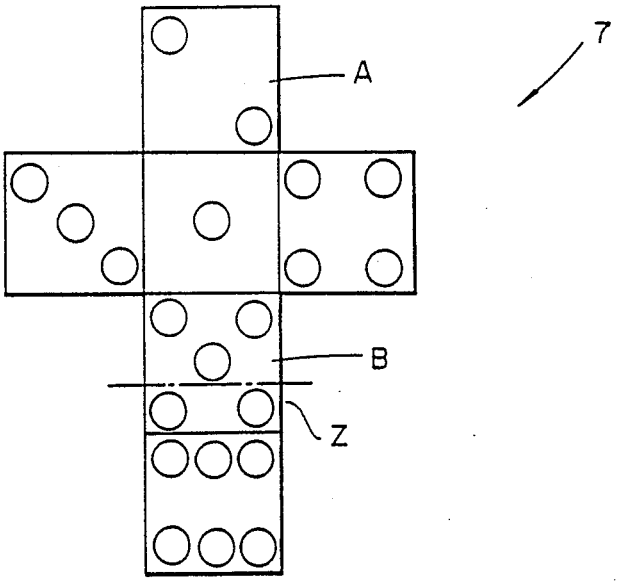
Figure 12:
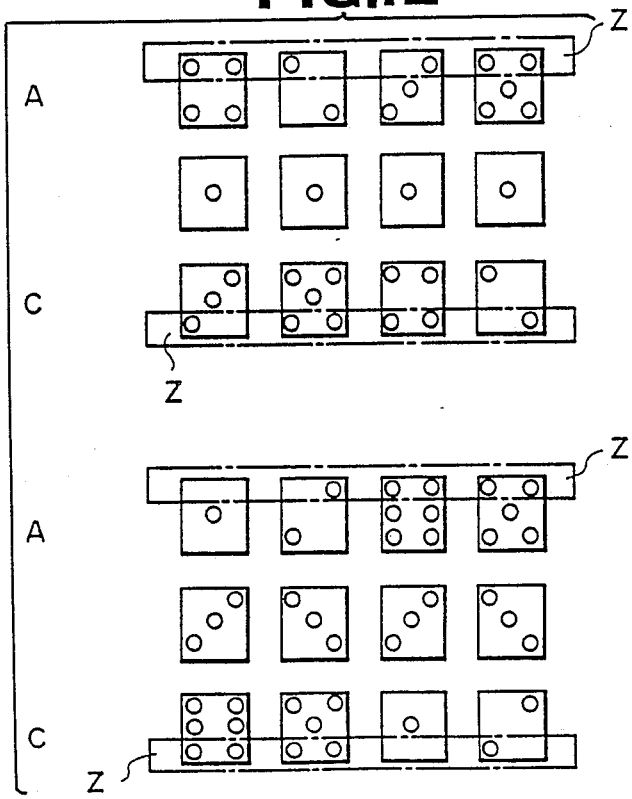

Now, the spot counting sensor TS will be described in detail. FIG. 11 shows the sides of the die, showing the numbers of spots from 1 to 6 on the die. Also, FIG. 12 shows the numbers of spots on opposite sides of the die in upper and lower lines A and C and the numbers of spots on the intermediate sides of the die in the center line. As seen from the number of spots encircled with chain lines Z in the upper and lower lines A and C, no matter which sides may face the sides of the spot counting channel, the lower part of either of opposite sides of the die bears two spots. As shown in FIGS. 9 and 10, two photosensors S1 and S1' are put to detect two spots at the lower part of a selected side of the die, and another two photosensors S2 and S2' are put to detect two spots at the lower part of the opposite side of the die. With this arrangement either pair of photosensors will detect two spots when a die is put right in the spot counting position 6A. After assuring that the die has been put right in the spot counting position 6A, the number of spots of the die will be counted. This permits the correct spot counting even if photosensors of relatively poor quality should be used.

Figure 3:
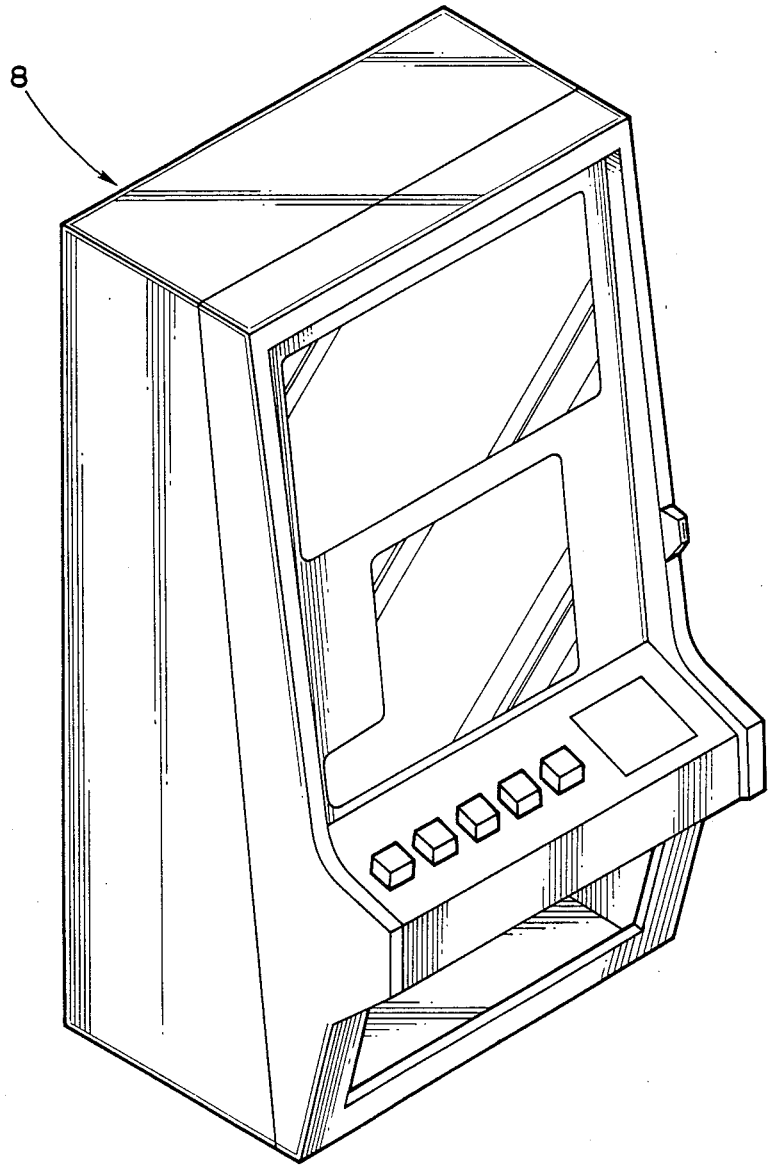
Figure 4:
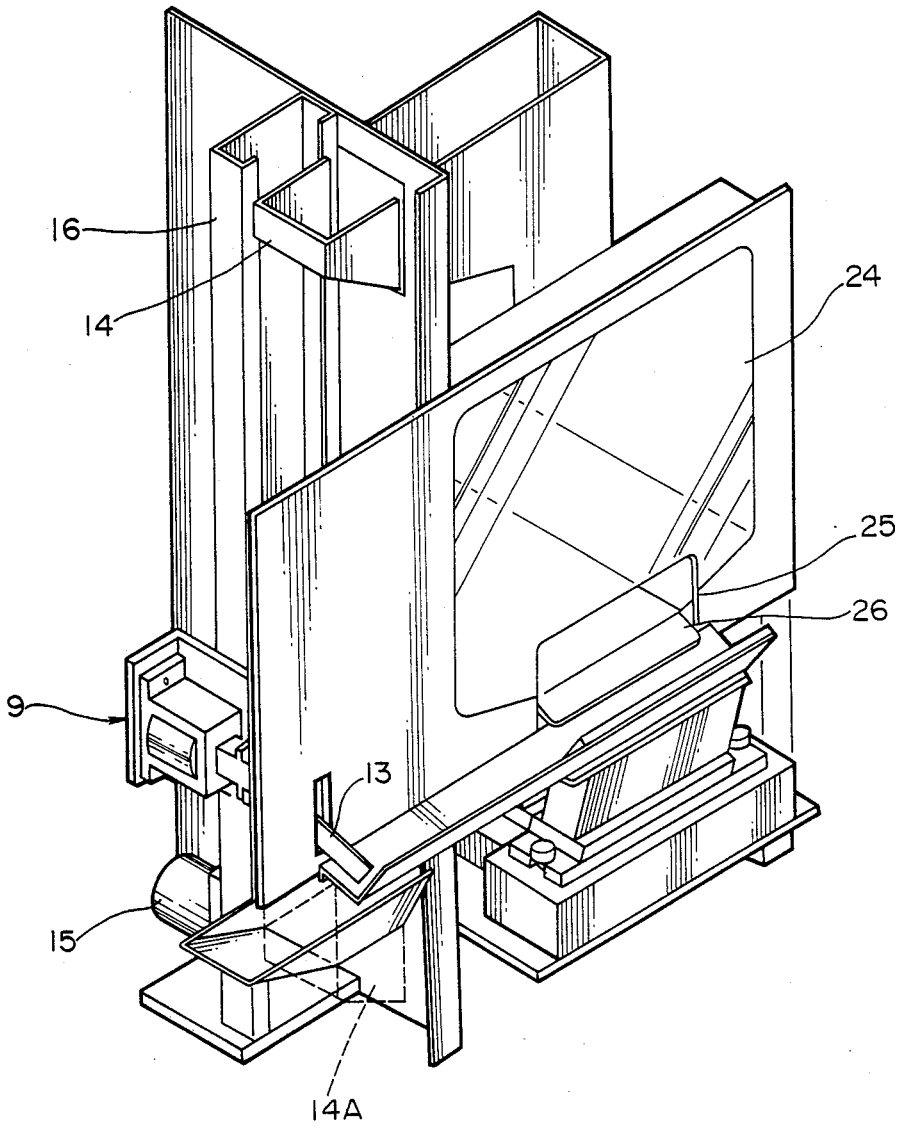

FIG. 3 shows the external appearance of a die machine equipped with die retrieving feeder 2 and a spot counting feeder 3 according to the present invention, and FIG. 4 shows the inner appearance of the die machine 6. The die retrieving feeder 2 and the spot counting feeder 3 are put at the center of the whole system. A window 24 is positioned so that the retrieving feeder 2 and the spot counting feeder 3 can be viewed, thereby permitting a player to see a die falling and rolling about on the vibrating feeder surface 4. A slot 25 is provided along the boundary P between the die retrieving feeder 2 and the spot counting feeder 3 just below the window 24. A connecting plate 26 overhangs the linear channel. The slot 25 is high enough to allow a die to pass therethrough.

Figure 13:
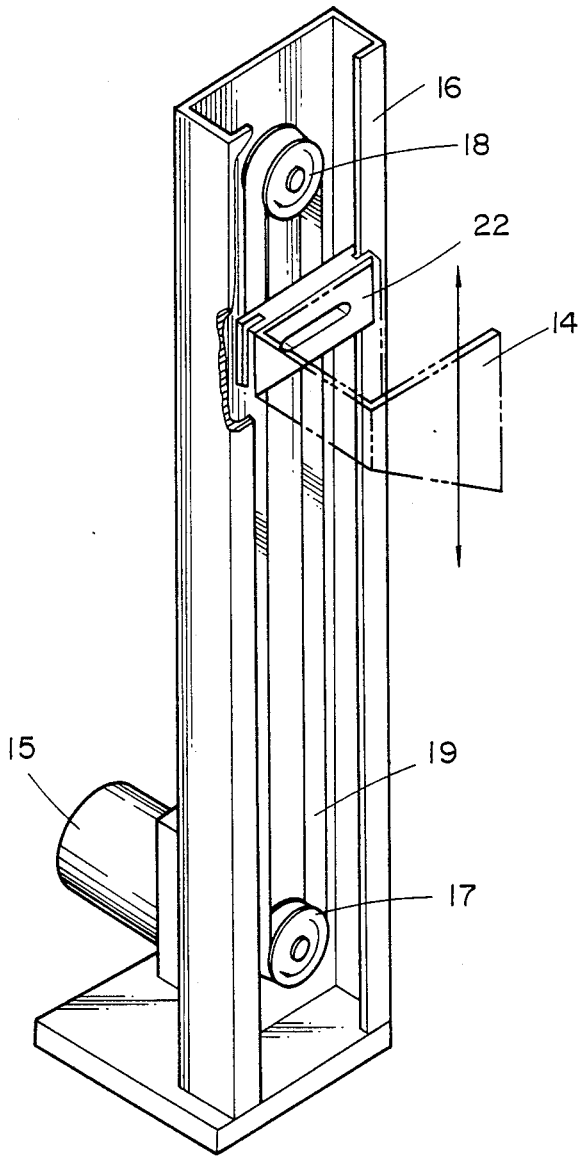

Also, a vertical guide rail 16 stands at the left side of the die retrieving feeder plane 4. As shown in FIG. 13, a bucket 14 having a bottom inclined rightwards is raised to a predetermined upper position. This bucket 14 can be moved up and down from a predetermined lower position 14A at the same level as the spot counting feeder 3 to the predetermined upper position along the vertical guide rail 16. A drive motor 15 is provided for the purpose.

Figure 14:
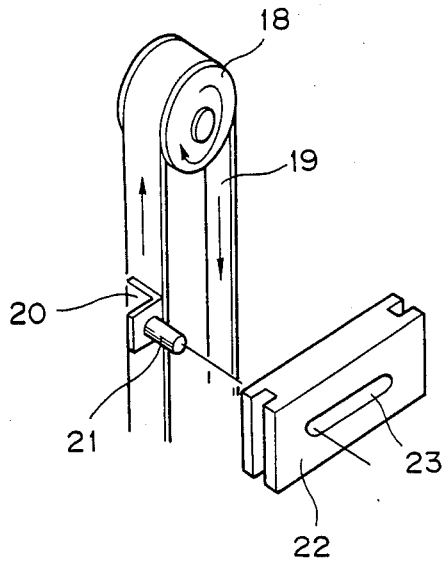

As shown in FIG. 13, a guide wheel 18 is rotatably fixed at the top position of the guide rail 16, and a drive wheel 17 is rotatably fixed at the bottom position of the guide rail 16. An endless belt 19 runs around these guide and drive wheels. The endless belt 19 has an "L"-shaped metal 20 with a drive pin 21 fixed thereto as shown in FIG. 14.

One side 22 of the bucket 14 has a lateral slot 23 made along the horizontal center of the plate. The drive pin 21 is inserted in the slot 23 of the bucket 14, and the bucket 14 is slidably fitted in the guide rail 16. Thus, the bucket 14 can move up and down along the guide rail 16 when the drive motor 15 drives the endless belt 19 via the drive wheel 17.

Figure 15:
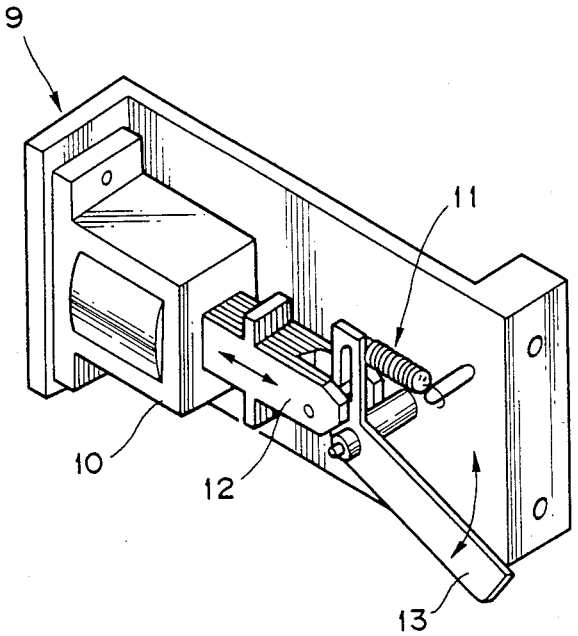
Figure 16:
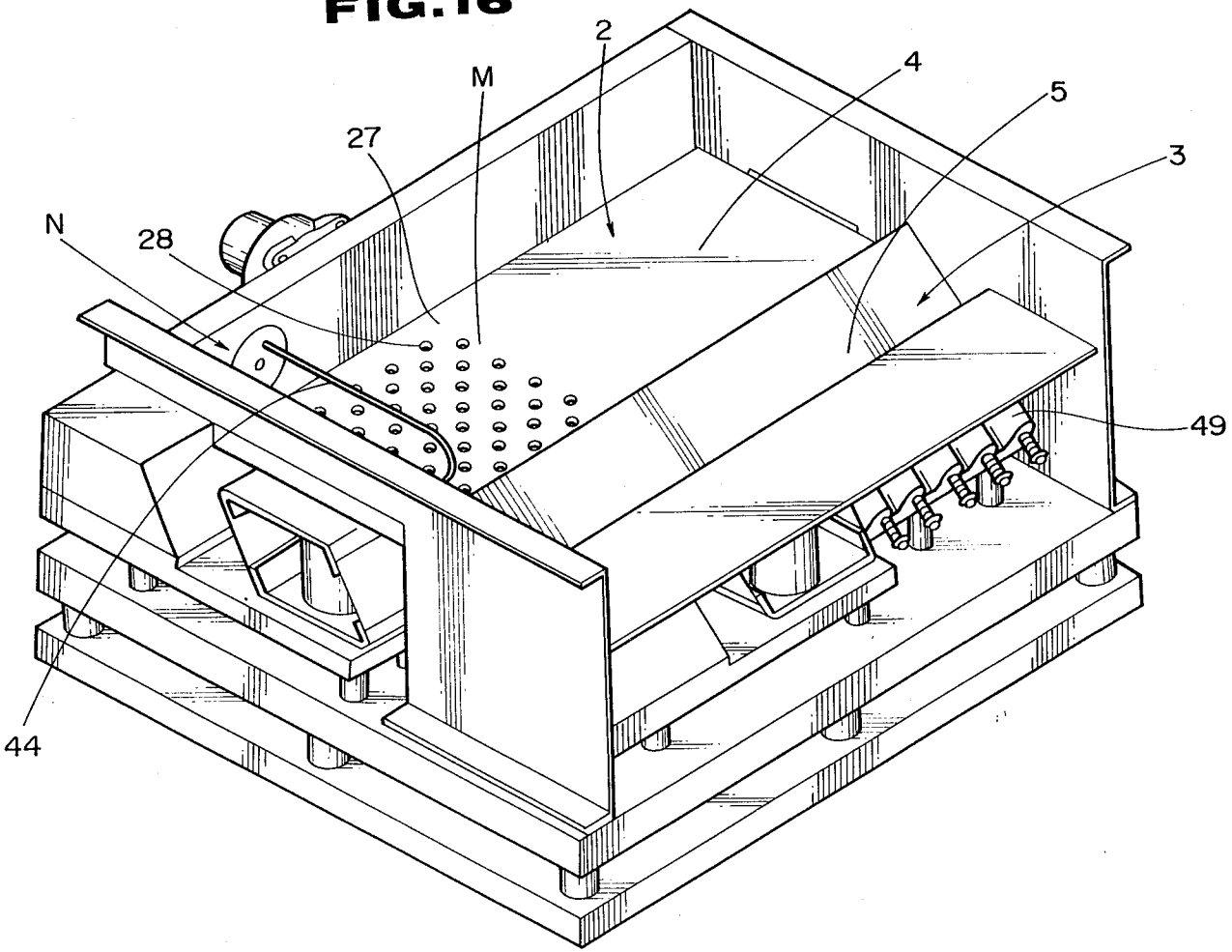
FIGS. 16 to 24 show a die machine according to a second embodiment of the present invention.
Figure 17:
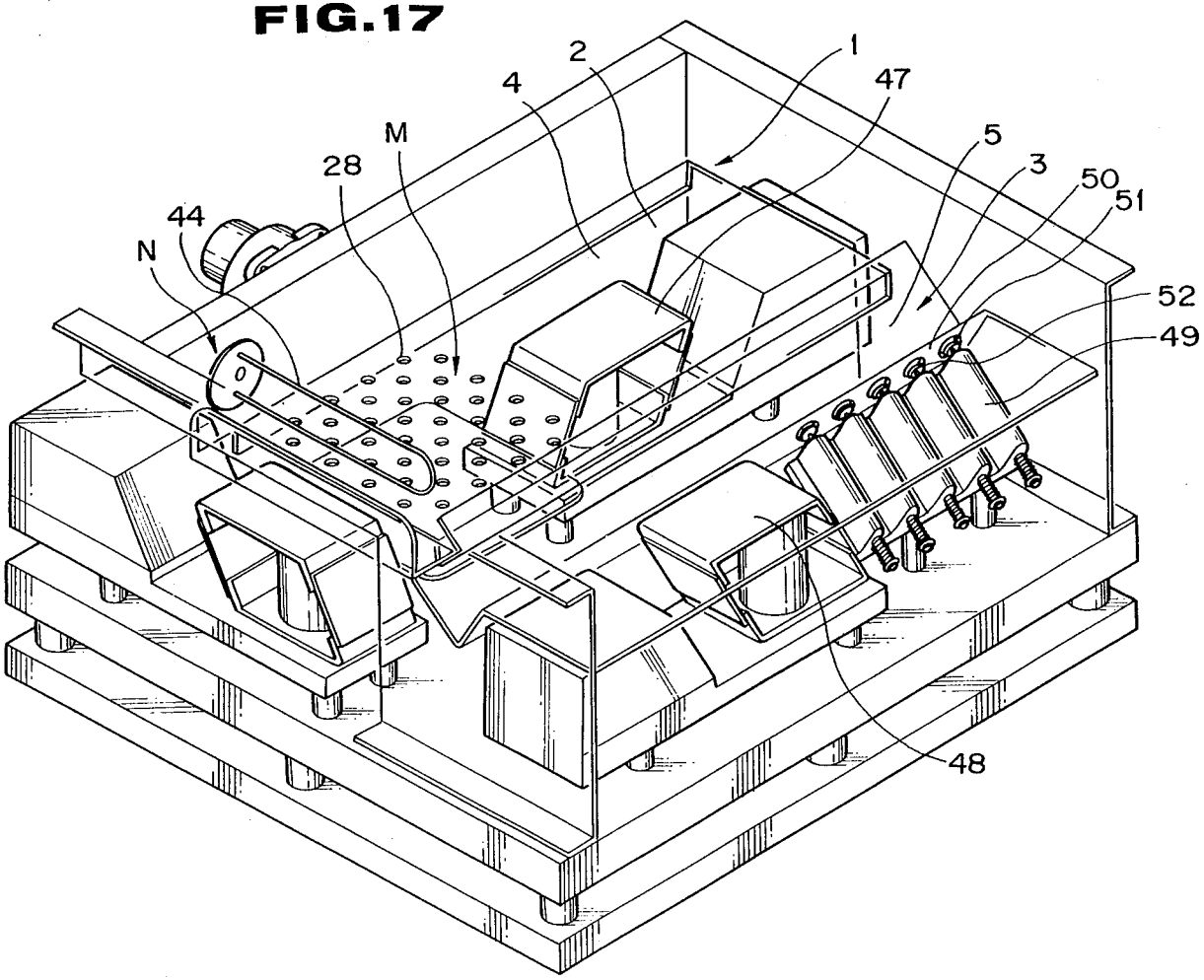

A die stopper 13 is provided to the left end of the linear channel 5. As best shown in FIG. 15, a stopper drive means 9 using for instance, electromagnetic drive, is provided for operating the die stopper 13. Specifically, a solenoid 10 has a core 12 connected to the die stopper 13. Normally, the core 12 is resiliently biased to its pull-out position by an associated spring 11. When the solenoid 10 is energized, the core 12 is pulled into the solenoid 10 to raise the die stopper 13 for opening the channel 5. When the solenoid 10 is deenergized, the core 12 is pulled out from the solenoid 10 to lower the die stopper 13 for closing the channel 5.

Figure 5:
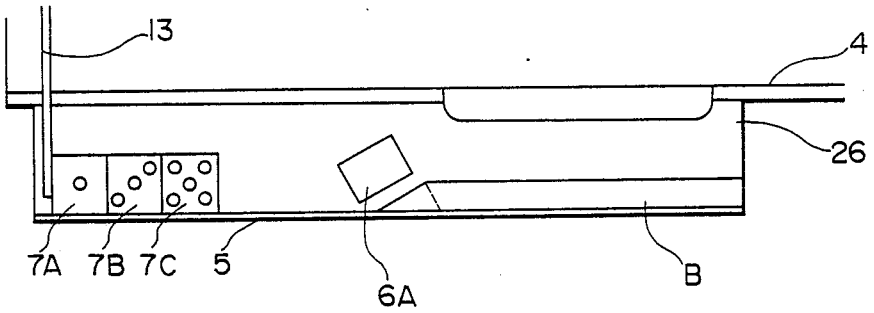

Now, the operation of the die machine will be described with reference to FIGS. 4 to 8. FIG. 5 shows the channel 5 of the die machine 8 before the start of operation. As shown, dice 7A, 7B and 7C are aligned in the channel 5, and the die stopper 13 is lowered.

Figure 6:
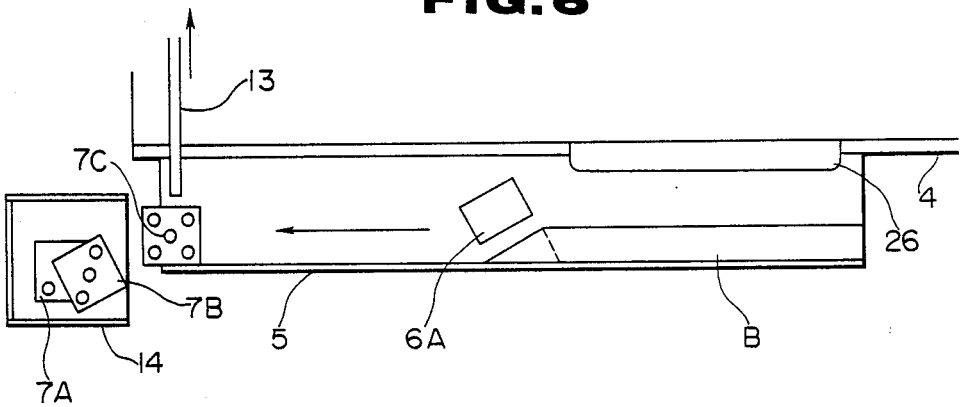

When the game starts, the channel feeder 3 starts vibrating to cause the dice to advance as shown in FIG. 6. At the same time the solenoid 10 is energized to draw the core 12, so that the stopper 13 is raised to open the channel 5. Thus, dice 7A, 7B and 7C fall in the bucket 14 one after another.

Then, the drive motor 15 drives the endless belt 19 via its drive wheel 17 to raise the bucket 14 to the same level as the guide rail 16. Thus, the bucket 14 carried the dice from the lower to upper position.

Figure 7:
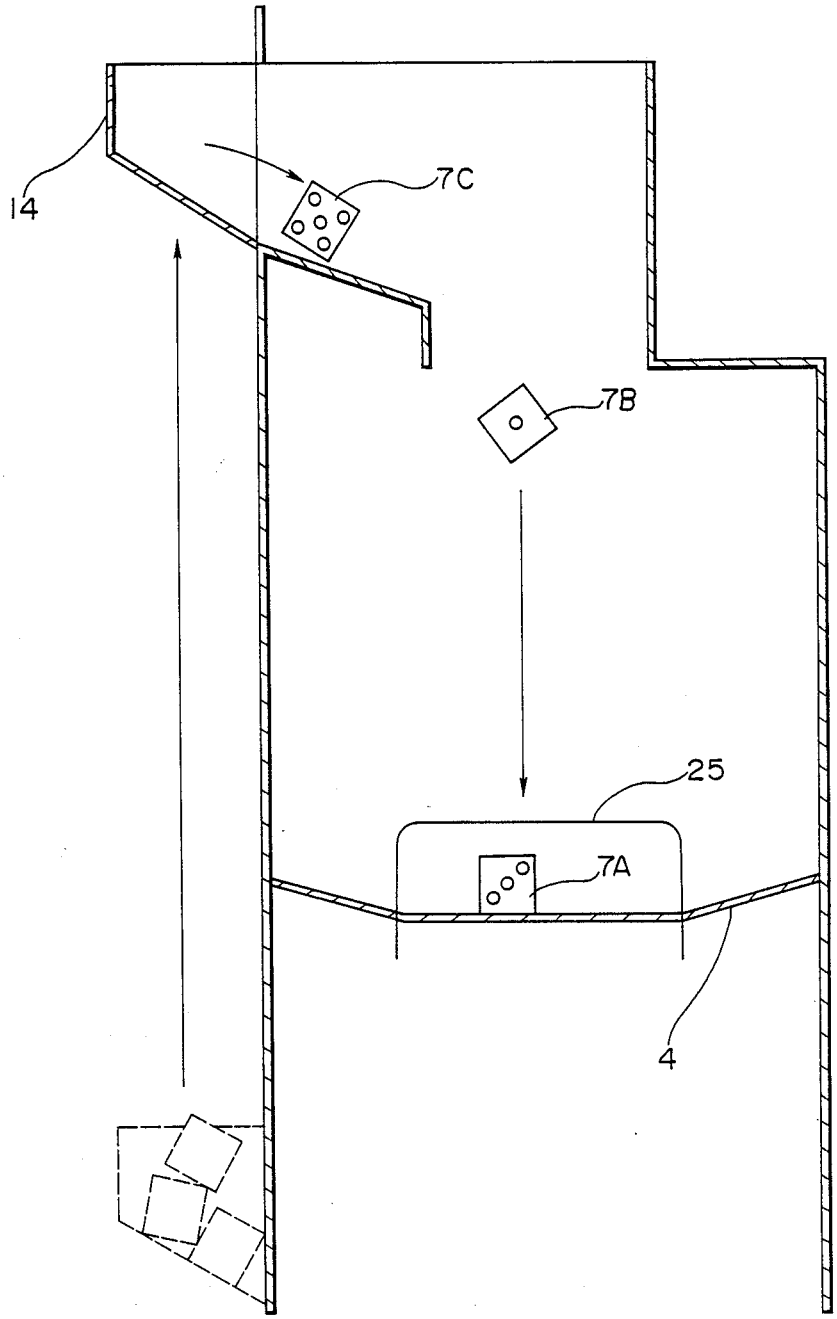

As described earlier, the bottom of the bucket 14 is inclined, and therefore, when the bucket 14 is brought to the upper position, the dice 7A, 7B and 7C are thrown one after another, falling on the transporting surface 4 (FIG. 7).

No matter in which directions these dice may be thrown, they fall on the dice retrieving feeder 2 without turning aside therefrom, and they roll about. Then, the dice 7A, 7B and 7C pass through the window slot 25 to slide down the slant bridge plate 26 and fall into the linear channel 5. These dice are brought to the stopper 13 by the linear transporting feeder 5, and then the spots of these dice are counted by the spot counting means 6.

Figure 8:
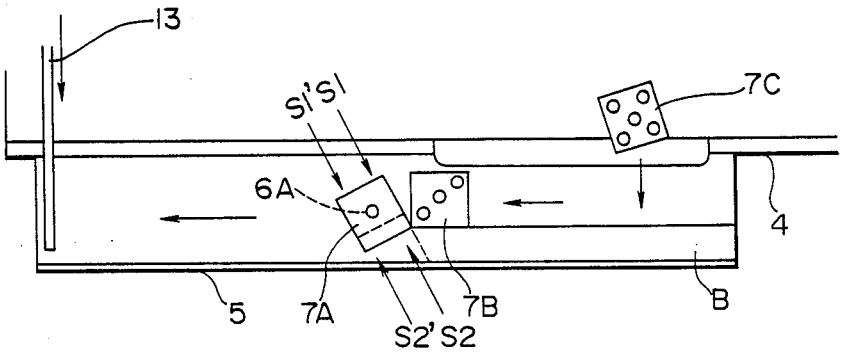

One die 7A is guided by the slant extension of the guide block B to the spot counting position 6A. A decision as to whether or not the die is positioned correctly on the spot counting position is made by detecting the appearance of "two" spots in the lower part of either of selected opposite sides of the die. When "two" spots are detected, the number of spots of a selected side of the die is counted by the photosensitive sensor TS (FIG. 8). This is repeated for each subsequent die.

When finishing the spot counting, the game ends, and the die machine will be reset to the state as shown in FIG. 5.

The result of the game can be dependent on appearance of a preselected number or numbers, odd or round numbers of spots of a single or a plurality of dice in combination.

Now, a die machine according to the second embodiment of the present invention will be described with reference to FIGS. 16 to 24.

For the sake of convenience parts of the second embodiment appearing in these drawings which are the same as those of the first embodiment are indicated by the same reference numerals as used in FIGS. 1 to 15. The description of such same parts is omitted, and only the parts which are exclusively used in the second embodiment are described below. Also, for the sake of simplicity in illustration only the parts characteristic of the second embodiment are selectively shown, and photosensors TS, guide block B, stopper 12 and bucket and associated mechanisms are not shown although these are equally used in the second embodiment.

The die machine according to the second embodiment is different from the first embodiment in that the die retrieving feeder has two die rolling means. One die rolling means comprises a square arrangement of vertically movable pins "M" and an associated pin drive. Specifically, the die retrieving feeder plane 2 has a plurality of pin holes 28 an its downstream side.

Figure 20:
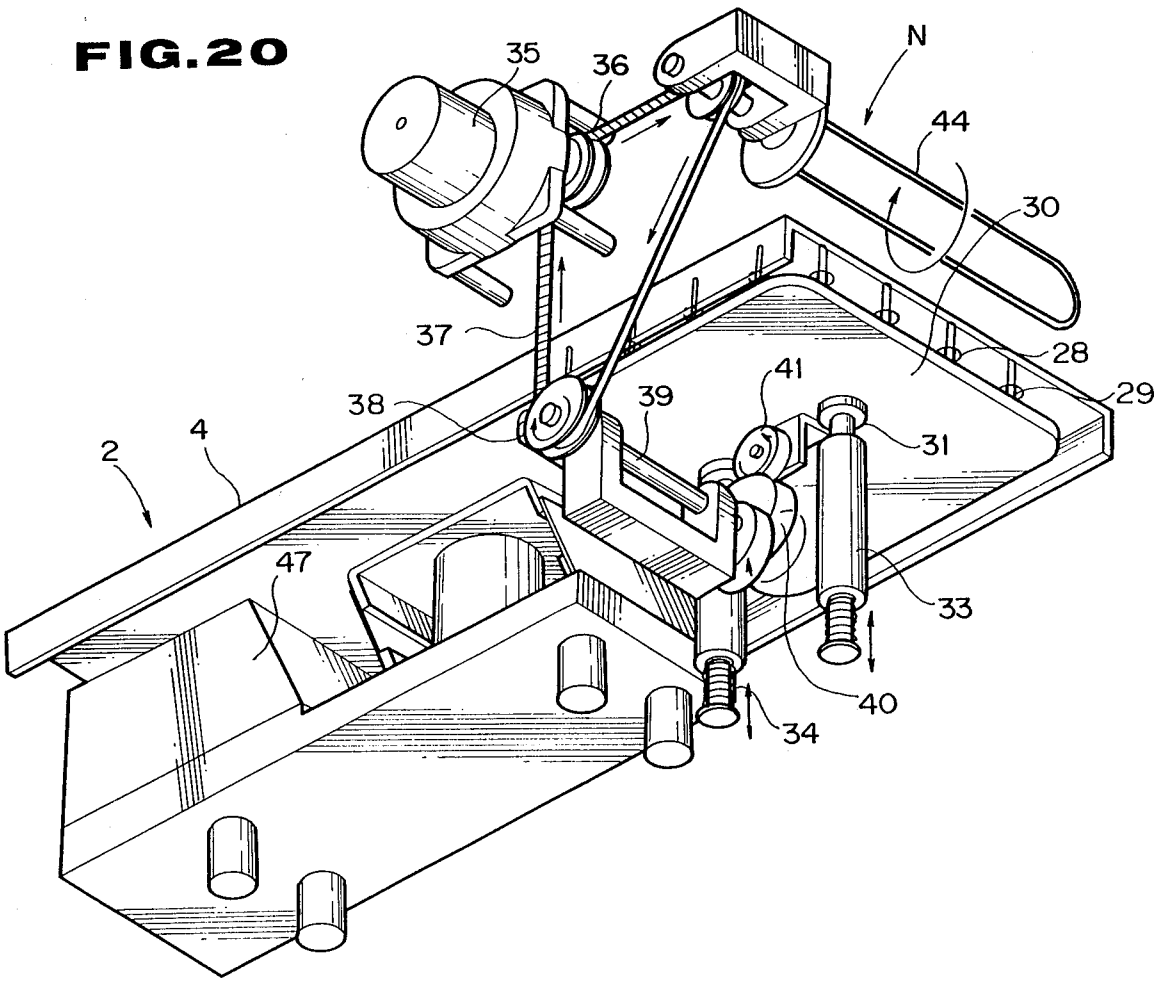
Figure 21:
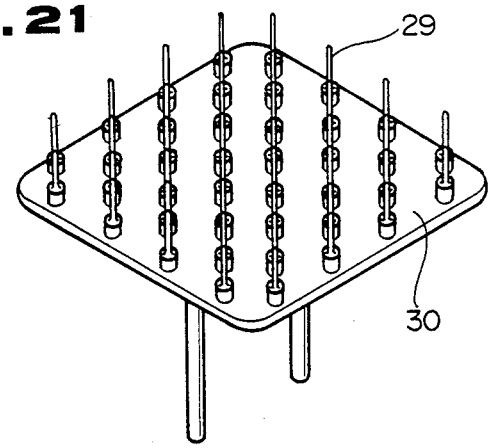
Figure 22:
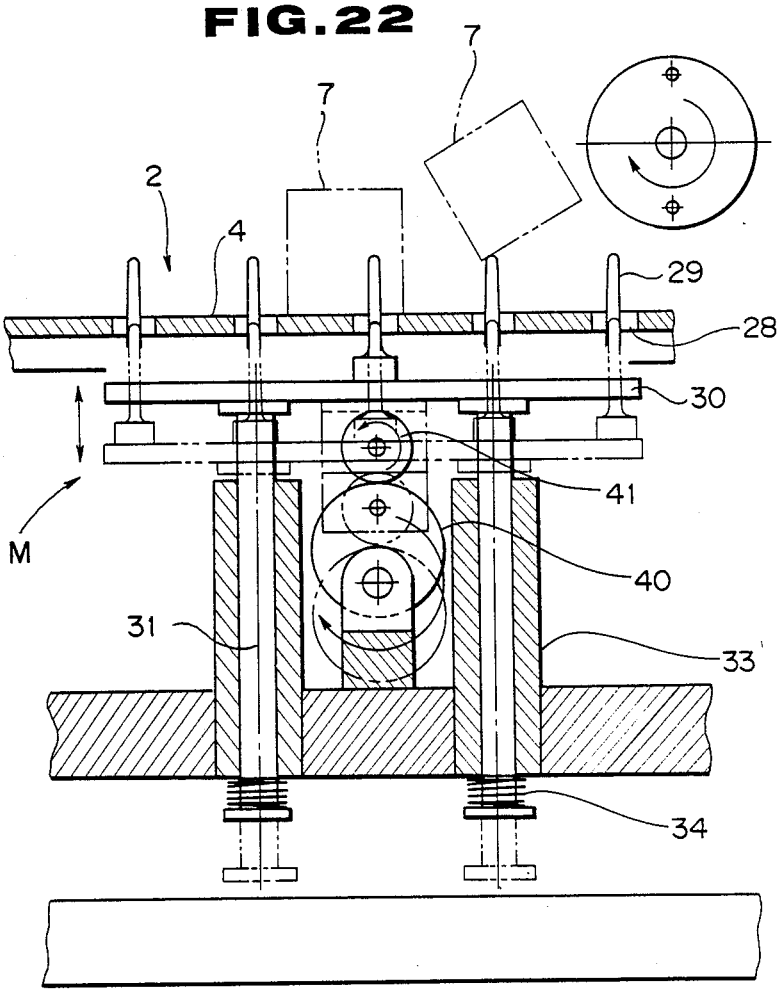
Figure 23:
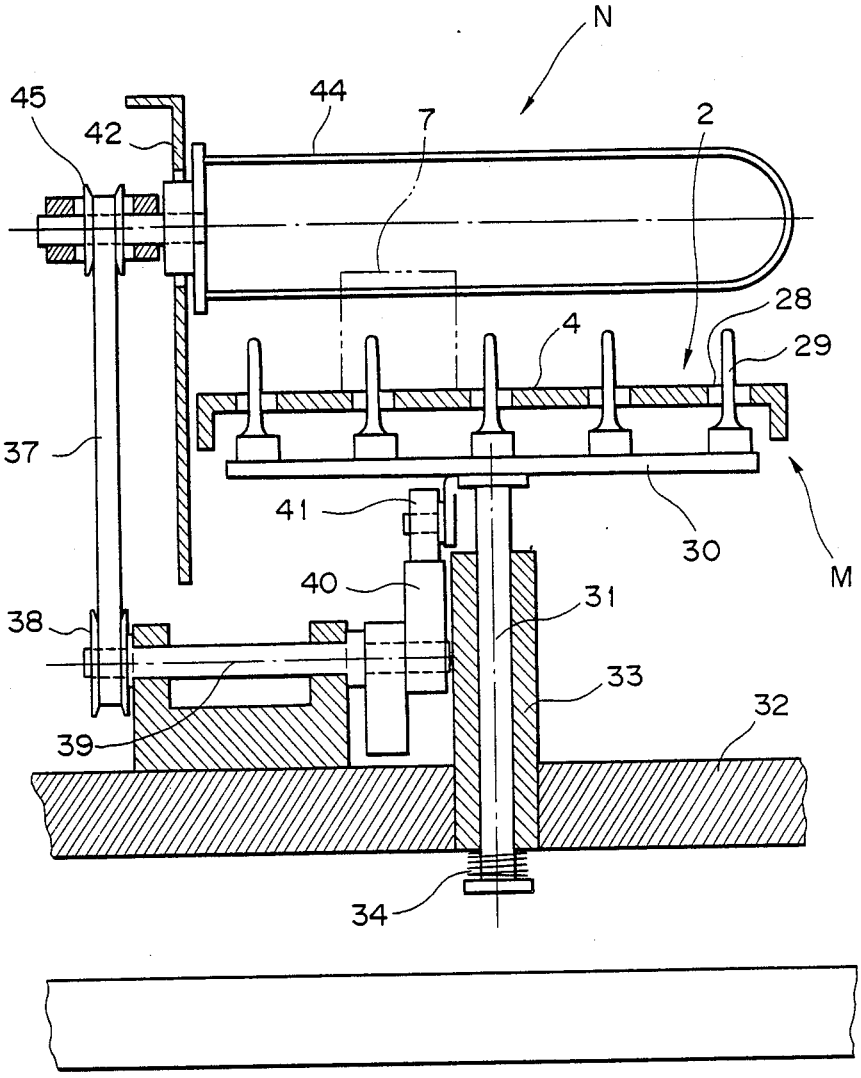

Each pin hole has a vertically movable pin 29 inserted therein. These pins are set on a pin table 30 (FIG. 21). This pin table 30 has slidable shafts 31 fixed to its backside, and these slidably fit in guide pipes 33, which are set in the base plate 32 (FIGS. 20 21, and 23). Normally, the slidable shafts 31 and hence the pin table 30 are held down by springs 34 until the pins 29 disappear from the dice retrieving feeder plane 4. A pin driver means comprises a motor 35, a sprocket wheel 38, a shaft 39, eccentric cams 40, and a cam follower 41 (FIG. 20). The cam follower 41 is rotatably fixed to the backside of the pin table 30. The pin table 30 is resiliently biased downwards, and is raised by the pin driver means when the motor 35 is energized. Thus, the pins 29 appear and disappear on the die retrieving feeder plane 4.

Another dice rolling means comprises a "U"-shaped arm "N" and an associated arm drive.

In this example the "U"-shaped arm "N" is composed of a "U"-shaped piece 44 and a shaft 43, and is rotatably supported by the side wall 42. A sprocket wheel 45 is attached to the shaft 43, and an endless belt 37 connects the sprocket wheel 45 and a motor 35. The "U"-shaped arm "N" is put at the downstream position in the die retrieving feeder 4 with its arm extending above the feeder plane at such a level that the dice may be struck and rolled by the rotating arm.

An electromagnetic vibrator means 47 is provided in the lower half portion of the die retrieving feeder plane 3, and an electromagnetic vibrator means 48 is provided at one side of the spot counting channel 4. A plurality of solenoids 49 each having a core pin are arranged in a line downstream of photosensors (not shown) in the spot counting channel 5. One side wall of the spot counting channel 5 has as many holes 51 as the solenoids 49. These holes 51 are aligned in exact registration with the core pins of the solenoids 49. When these solenoids 49 are energized, their core pin heads 52 will project from the holes.

In operation the die 7 falls on the dice retrieving feeder plane 4 to roll down towards one end of the spot counting channel 5. While rolling about, the die 7 will be occasionally pushed up by selected ones of the vertically movable pins 29, which are moved up and down by the pin table 30. Specifically, the rotation of the eccentric cams 40 causes the rotation of the cam follower 41, and hence the rise and descent of the pin table 30. Accordingly, the vertically movable pins 29 are projected from the holes 28, and are pulled down by springs 34 to sink in the holes 28. The start and stop of rotation of the eccentric cams 40 can be controlled by a player, that is, by depressing control buttons or knobs (illustrated but not numbered in FIG. 3). Thus, the player can play the game in the thrill of anticipation of the appearance of the number of spots which he desires. This will increase amusement even more.

Figure 18:
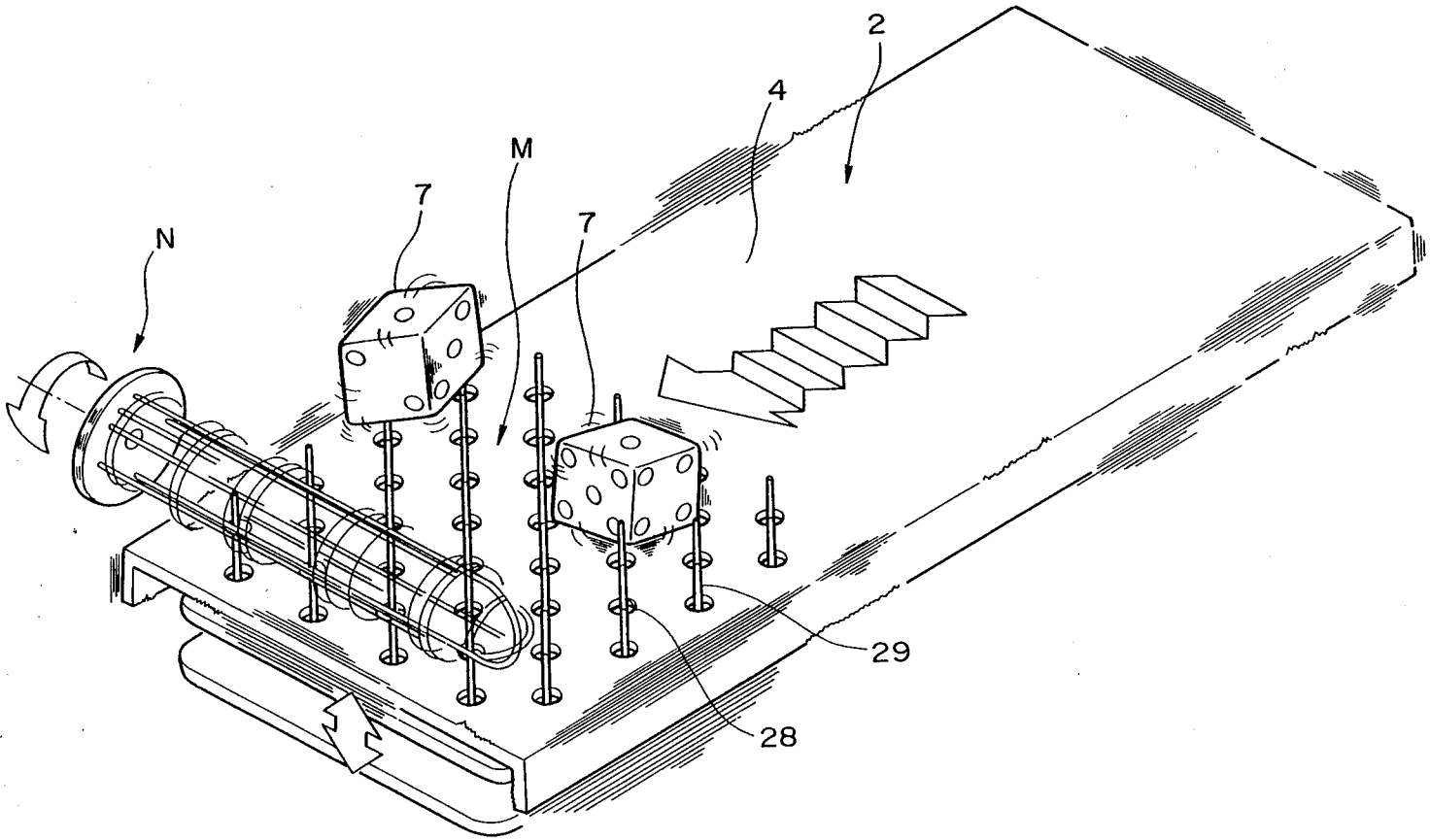
Figure 19:
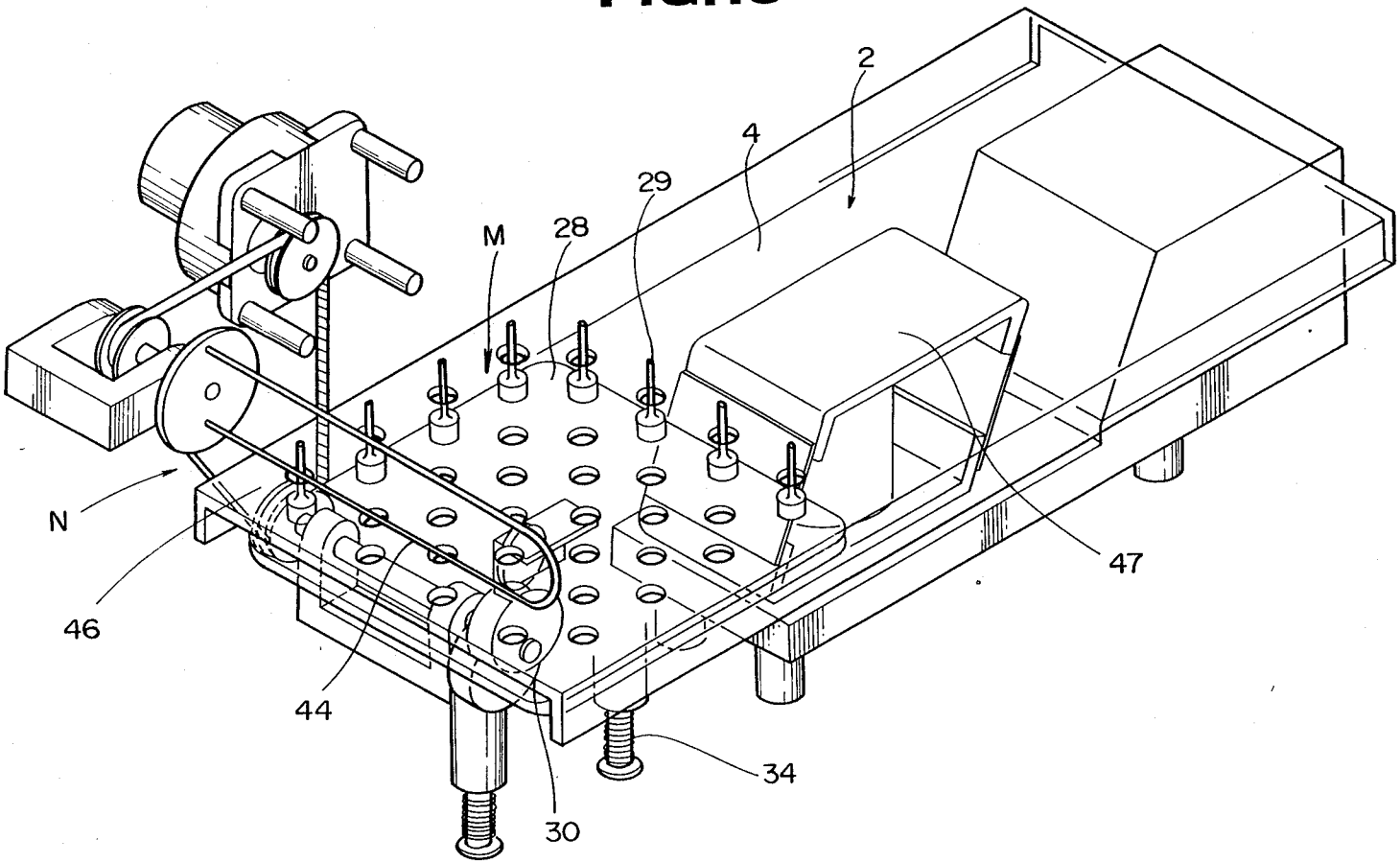

When driven by the drive motor 35 through the agency of the belt 37, the "U"-shaped arm piece N is rotated to occasionally strike the die 7, thus causing it to roll, as best shown in FIG. 18. This increases amusement in dicing.

Figure 24:
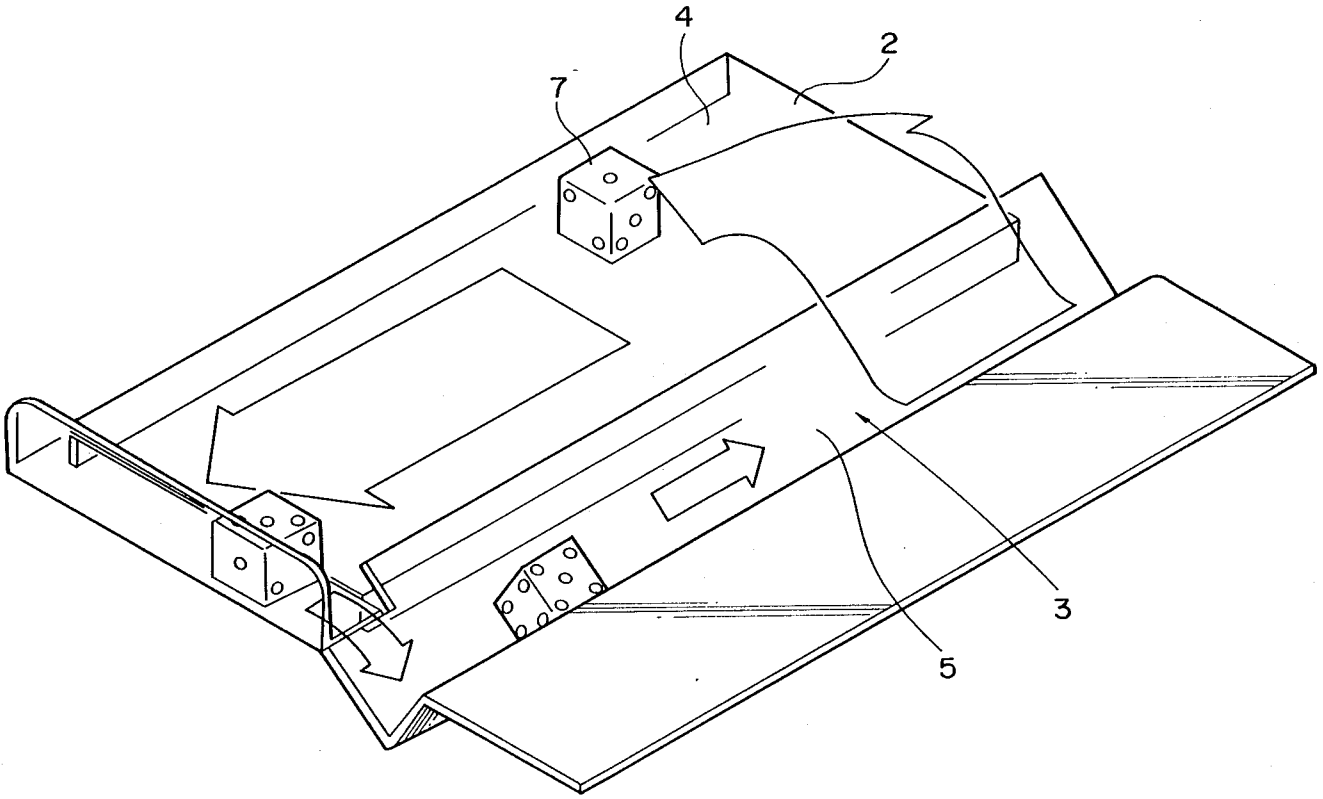

After rolling down the die retrieving feeder plane 4, the die falls into the spot counting linear channel 5. The vibration of the spot counting channel 5 causes the die to advance straight to the spot counting position 6A, where the number of a selected side of the die 7 is counted by the spot counting sensors. After that the die 7 is raised and put on the die retrieving feeder plane 4 by the core heads 52 of the solenoids 49. This die move subsequent to the falling onto the die retrieving feeder plane, is best shown in FIG. 24.

In this particular example there are five solenoids 49, which can be simultaneously or sequentially operated, thereby raising and putting the die 7 on the die retrieving feeder plane simultaneously or one after another.

This embodiment uses two die rolling means. Another example of die rolling means is an air-blowing die rolling means. A pin square matrix may be put sideward so as to give a sideward push to the die. A variety of modifications would be obvious to those skilled in the art. Therefore, the die rolling means is not limited to that described above and shown in the drawings.

Advantages of the die machines described in attached claims are:

No matter which direction a die may be thrown, the die will fall on the relatively extensive die retrieving feeder plane without turning aside therefrom, still assuring that the die is carried straight to the relatively small, spot counting place and that the number of spots on a selected side of the die is counted exactly.

The spot counting channel has a "V"-shaped side walls, thereby permitting the exact positioning of the spot counting sensors by using the inclined wall surface, and making it easy to feed the die along the straight path.

A player can roll the die in the dice retrieving feeder plane, thus increasing the thrill of anticipation of a desired spot number, and hence excitement.

The die can be occasionally pushed up and rolled about, and then the die is thrown in all directions depending on which part of the die is struck, thus causing complicated move of the die for amusement.

The die can be occasionally rotated by the "U"-shaped arm. Sometimes, the die can pass the rotating "U"-shaped arm without being struck, and the player may be required to control the "U"-shaped rolling means with skill because otherwise, the player would miss the rolling die. This will increase amusement.

The die can be subjected to up-and-down and rotating motions.

What is claimed is:

1. A die throwing machine comprising:

a vibrating feeder on which a die is to be thrown, said feeder having at least two divisional sections integrally connected with each other, a first divisional section and a second divisional section, said first divisional section receiving a thrown die and having a vibratory transporting surface large enough to receive the die and allow it to rotate in all directions while transporting it toward said second divisional section, said second divisional section having spot counting means for counting the number of spots of a selected side of said die and a vibratory transporting channel along which the die is linearly transported to a counting place at which the spot counting means is provided.

2. A die throwing machine according to claim 1 wherein the transporting channel has a "V"-shaped cross section, the square block of the die fitting snugly in the channel.

3. A die throwing machine according to claim 1 wherein the first divisional section has means for controlling the rolling of the die on the transporting surface and means for operating said control means disposed at the exterior of said die throwing machine.

4. A die throwing machine according to claim 3 wherein the transporting surface has a plurality of apertures, said controlling means including a group of vertically movable pins in exact alignment with the apertures of the transporting surface and means for raising and lowering these pins, thereby allowing them to appear and disappear from corresponding apertures of the transporting surface thereby pushing the rotating die.

5. A die throwing machine according to claim 3 wherein the control means comprises a rotatable "U"-shaped arm extending above the transporting surface and means for rotating the "U"-shaped arm.

6. A die throwing machine according to claim 3 wherein the transporting surface has a plurality of apertures, and said controlling means comprising a group of vertically movable pins in exact alignment with the apertures of the transporting surface, means for raising and lowering these pins, said controlling means further comprising a rotatable "U"-shaped arm extending above the transporting surface and rotating means for rotating the "U"-shaped arm.

* * * * *